US009879485B2

(12) United States Patent
Glaser et al.

(10) Patent No.: US 9,879,485 B2
(45) Date of Patent: Jan. 30, 2018

(54) STABILIZER

(71) Applicant: Weatherford Technology Holdings, LLC, Houston, TX (US)

(72) Inventors: Mark C. Glaser, Houston, TX (US); William Allen Schultz, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 284 days.

(21) Appl. No.: 14/569,414

(22) Filed: Dec. 12, 2014

(65) Prior Publication Data

US 2016/0168924 A1 Jun. 16, 2016

(51) Int. Cl.
*E21B 17/10* (2006.01)
*E21B 29/00* (2006.01)

(52) U.S. Cl.
CPC ..... *E21B 17/1014* (2013.01); *E21B 17/1042* (2013.01); *E21B 17/1078* (2013.01); *E21B 29/002* (2013.01)

(58) Field of Classification Search
CPC ..... E21B 17/1014; E21B 17/1042; E21B 17/1078; E21B 31/12; E21B 31/16; E21B 31/20
See application file for complete search history.

(56) References Cited

U.S. PATENT DOCUMENTS 1,608,828 A * 11/1926 Wright ..... E21B 31/20 294/86.25
2,117,050 A * 5/1938 Wilson ..... E21B 29/005 166/55.7
2,170,527 A * 8/1939 Culbertson ..... E21B 17/1021 166/241.6
2,651,199 A * 9/1953 Collins ..... E21B 17/1042 166/241.5
2,715,552 A 8/1955 Lane
3,981,359 A * 9/1976 Fortenberry ..... E21B 43/10 166/241.6
4,465,222 A 8/1984 Hester
4,938,299 A 7/1990 Jelsma
4,969,514 A * 11/1990 Morris ..... E21B 31/20 166/55
5,318,115 A * 6/1994 Rouse ..... E21B 4/02 166/361

(Continued)

FOREIGN PATENT DOCUMENTS

GB 851036 A 10/1960

OTHER PUBLICATIONS

PCT International Search Report and Written Opinion dated Mar. 3, 2016, for International Patent Application No. PCT/US2015/064991.

*Primary Examiner* — Jennifer H Gay
(74) *Attorney, Agent, or Firm* — Patterson + Sheridan, LLP

(57) ABSTRACT

A stabilizer for passing through a restriction includes a tubular body having a bore therethrough; a rigid blade disposed on the tubular body; and a deformable blade disposed on the tubular body, wherein the deformable blade includes a geometric profile configured to preferentially bend the deformable blade in one direction when the deformable blade encounters the restriction, and wherein the deformable blade has a height greater than a height of the rigid blade. In one example, the deformable blade is offset from a radial axis.

28 Claims, 19 Drawing Sheets

(56) References Cited

U.S. PATENT DOCUMENTS

| | | | | |
|---|---|---|---|---|
| 5,692,562 | A | 12/1997 | Squires | |
| 5,836,406 | A | 11/1998 | Schuh | |
| 6,435,275 | B1 | 8/2002 | Kirk et al. | |
| 6,484,803 | B1 * | 11/2002 | Gremillion | E21B 17/1028 166/241.1 |
| 7,357,178 | B2 | 4/2008 | Thornton | |
| 8,307,903 | B2 | 11/2012 | Redlinger et al. | |
| 2003/0070803 | A1 * | 4/2003 | Gremillion | E21B 17/1028 166/241.6 |
| 2004/0112592 | A1 * | 6/2004 | Gremillion | E21B 17/1078 166/241.6 |
| 2004/0178797 | A1 * | 9/2004 | Rioufol | E21B 17/1078 324/367 |
| 2005/0257934 | A1 * | 11/2005 | Baird | E21B 10/26 166/380 |
| 2007/0215388 | A1 * | 9/2007 | Kirk | E21B 17/1057 175/327 |
| 2010/0326665 | A1 * | 12/2010 | Redlinger | E21B 29/005 166/339 |
| 2013/0248206 | A1 * | 9/2013 | Jordan | E21B 19/24 166/381 |
| 2014/0251616 | A1 * | 9/2014 | O'Rourke | E21B 29/005 166/298 |
| 2016/0168924 | A1 * | 6/2016 | Glaser | E21B 17/1014 166/376 |

* cited by examiner

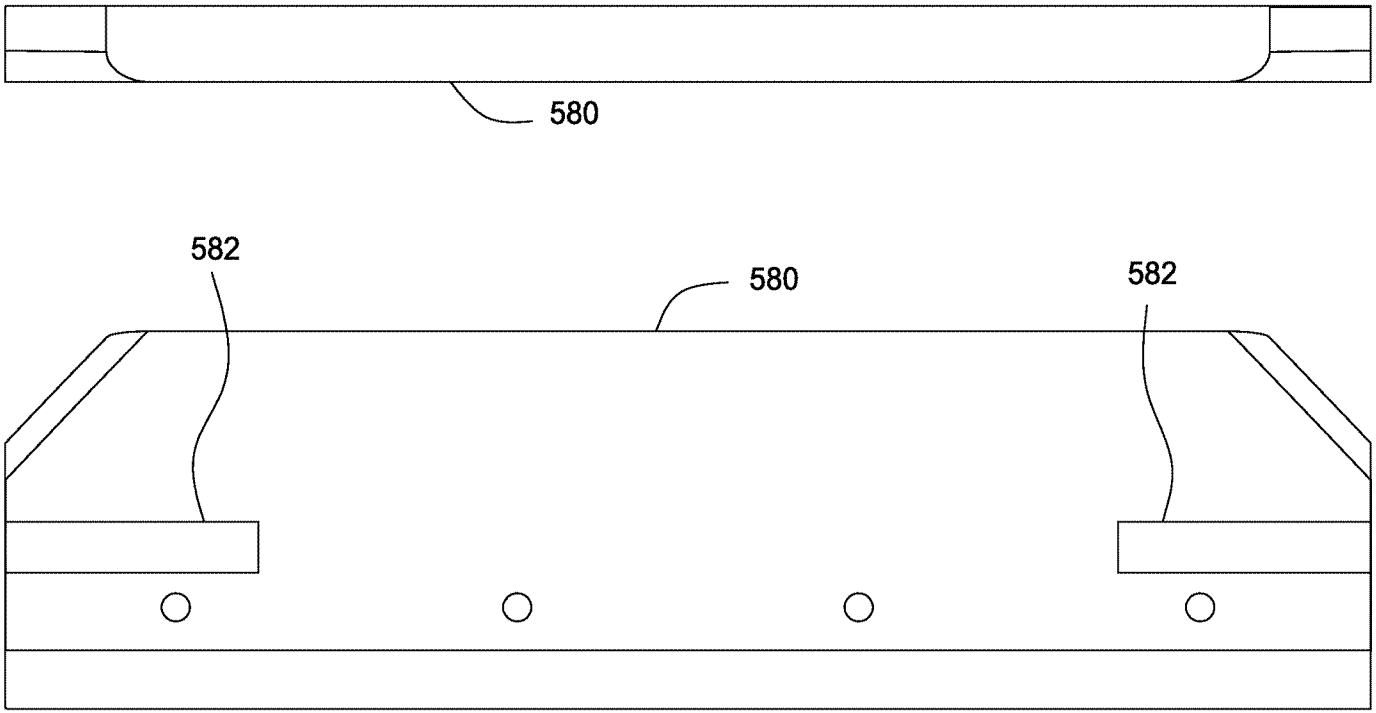
FIG. 15A
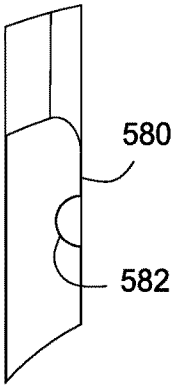
FIG. 15B
FIG. 15C

STABILIZER

BACKGROUND OF THE INVENTION

Field of the Invention

Embodiments of the present invention generally relate to a stabilizer for use in wellbore operations. In particular, embodiments of the present invention relate to a stabilizer having selectively deformable blades.

Description of the Related Art

Stabilizers are used to stabilize one tubular member inside a borehole or in another tubular member, e.g., to stabilize a first smaller casing in a second larger casing. Typically stabilizers are placed on the exterior of the inner casing and project outwardly therefrom. In many typical situations, the annular space between the outer circumference of the smaller casing and the inner circumference of the larger casing is sufficiently large that, with some force, a stabilizer on the inner first casing can be moved into the interior of the second outer casing.

In a variety of situations, the stabilizer may pass through a restriction in the wellbore that is smaller than the anticipated annular space. For example, the stabilizer may be required to pass through seal bores in a wellhead. As it passes through the wellhead, the radial stand-off force of the blades may damage the surface of the bores.

There is a need, therefore, for a stabilizer having selectively deformable blades.

SUMMARY OF THE INVENTION

Embodiments of the present invention generally relate to a stabilizer for use with a tubular in a wellbore operation. In one embodiment, one or more blades of the stabilizer may be deformed to facilitate passage through a restriction. Thereafter, the blades may return to its initial shape to support the tubular.

In one embodiment, a stabilizer for passing through a restriction includes a tubular body having a bore therethrough; a rigid blade disposed on the tubular body; and a deformable blade disposed on the tubular body, wherein the deformable blade includes a geometric profile configured to preferentially bend the deformable blade in one direction when the deformable blade encounters the restriction, and wherein the deformable blade has a height greater than a height of the rigid blade.

In another embodiment, a stabilizing assembly for passing through a restriction includes a central body having a bore therethrough; a first collar coupled to the central body; a second collar coupled to the central body; a tubular body disposed around the central body; a rigid blade disposed on the tubular body; and a deformable blade disposed on the tubular body, wherein the deformable blade has a height greater than a height of the rigid blade.

In another embodiment, a method of running a stabilizer coupled to a tubular string through a restriction includes coupling the stabilizer to the tubular string, bending a deformable blade of the stabilizer in response to contacting the restriction, thereby reducing the outer diameter of the deformable blade; moving the stabilizer past the restriction; and allowing the deformable blade to return to its original diameter. In one embodiment, the stabilizer includes a tubular body having a bore therethrough; a rigid blade disposed on the tubular body; and a deformable blade disposed on the tubular body, wherein the deformable blade has an outer diameter larger than an outer diameter of the rigid blade.

In another embodiment, a method of removing a wellhead connected to a casing includes coupling a stabilizer to a tubular string having a cutter, bending a deformable blade of the stabilizer as the stabilizer passes through the wellhead; and separating the wellhead from the casing using the cutter. In one embodiment, the stabilizer includes a tubular body having a bore therethrough; a rigid blade disposed on the tubular body; and a deformable blade disposed on the tubular body, wherein the deformable blade has an outer diameter larger than an outer diameter of the rigid blade.

In one embodiment, a stabilizer includes a body having a bore therethrough; a plurality of blades circumferentially disposed around the body; and a plurality of blade supports disposed adjacent a respective blade.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 15A-C illustrate another example of a deformable blade.

DETAILED DESCRIPTION

Embodiments of the present invention provide a stabilizer for use in wellbore operations. In one embodiment, one or more blades of the stabilizer are deformable for passing a restriction in the wellbore.

Figure 1:
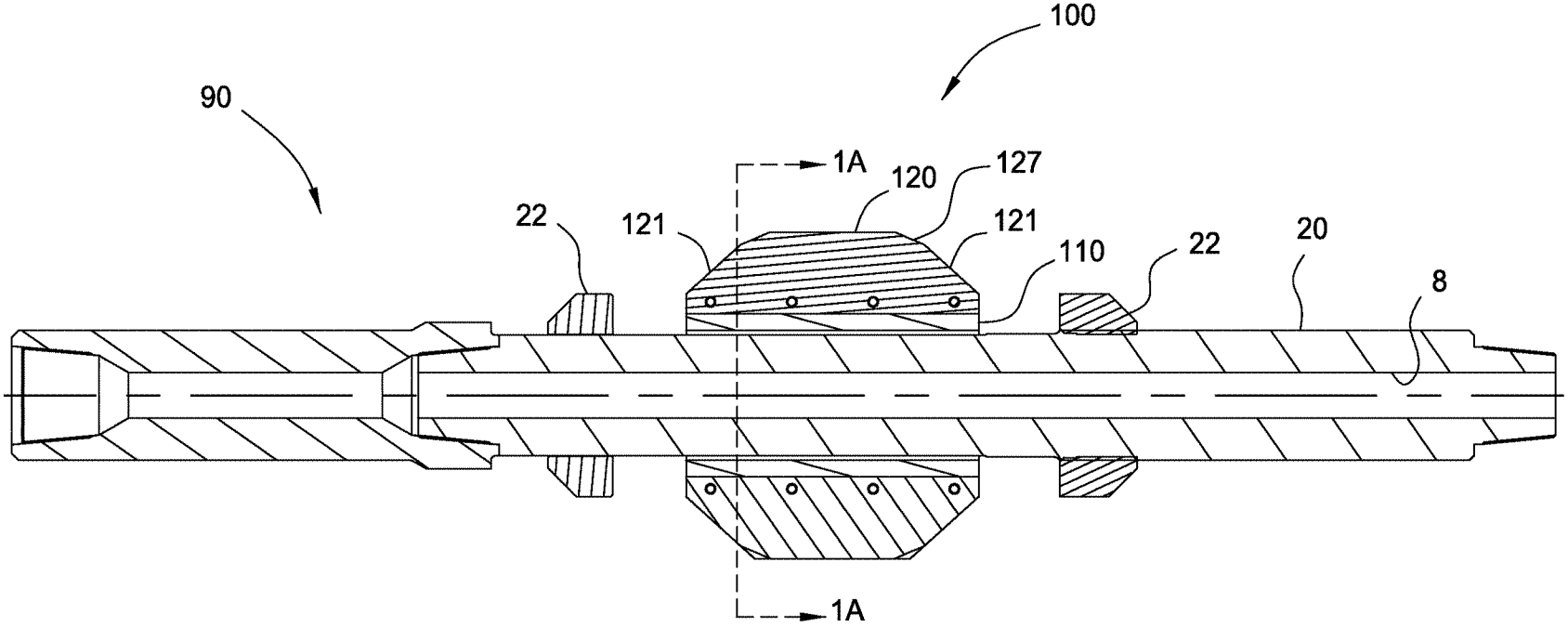
FIG. 1 illustrates a cross-sectional view of an embodiment of a stabilizing assembly.

FIG. 1 illustrates a cross-sectional view of an embodiment of a stabilizing assembly 90 suitable for use with a tubular string, such as a drill pipe string or casing string. The stabilizing assembly 90 includes a central body 20 and a stabilizer 100. The central body 20 has a longitudinal bore 8 extending therethrough and has ends adapted to be connected to the tubular string such as the drill pipe string. In another embodiment, the central body 20 may be formed integral with the tubular string. The exterior surface of the central body 20 optionally includes two axially spaced collars 22 configured to limit axial movement of the stabilizer 100. In this embodiment, the collars 22 are disposed on a recessed portion of the central body 20. In another embodiment, the upset of the tubular string may act as a collar for the stabilizer 100. In yet another embodiment, the stabilizer 100 may be disposed directly on the tubular string.

Figure 1A:
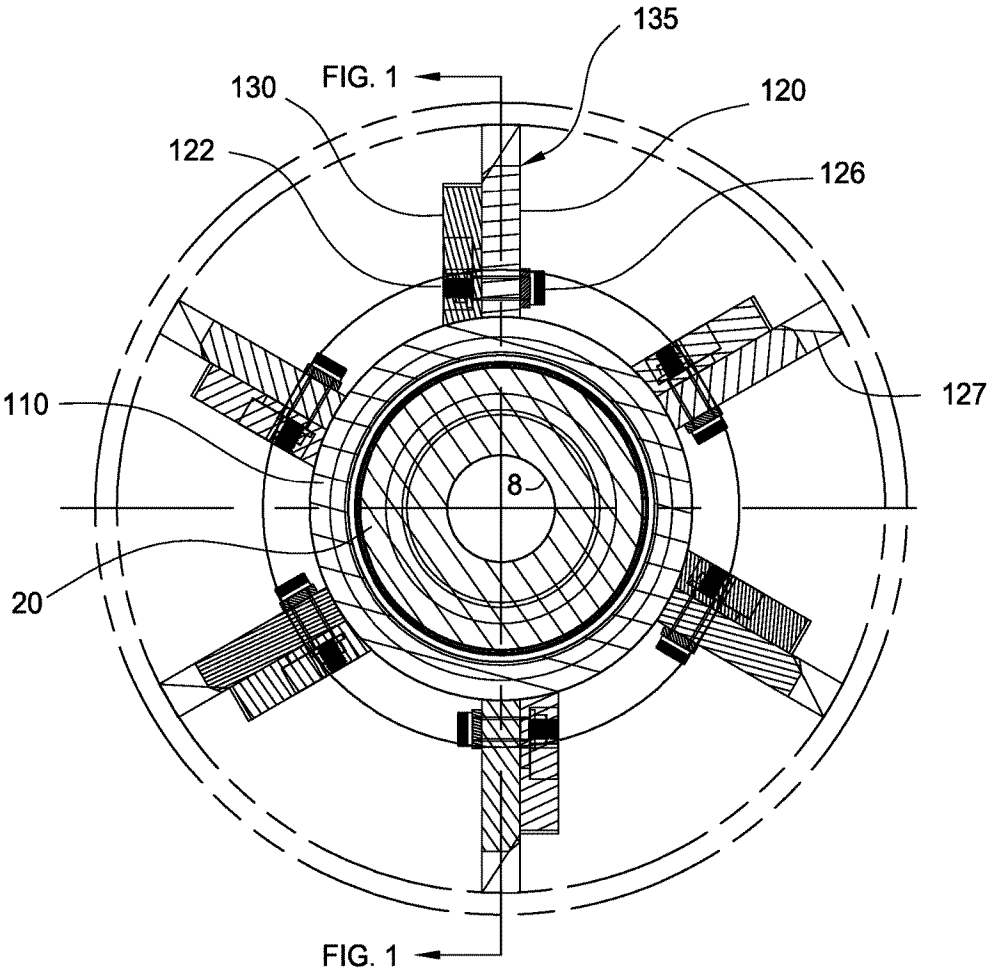
FIG. 1A is a cross-sectional view of the stabilizing assembly of FIG. 1.

In one embodiment, the stabilizer 100 includes a tubular body 110 and a plurality of blades disposed on an outer surface of the tubular body 110. FIG. 1A is another cross-sectional view of the stabilizer assembly 90. As shown in FIGS. 1 and 1A, the bore of the tubular body 110 is larger than an outer diameter of the central body 20 such that the tubular body 110 is disposable around the central body 20. In this respect, the central body 20 is rotatable relative to the stabilizer 100.

As shown, a plurality of blade assemblies 135 is disposed circumferentially on the tubular body 110. Each of the blade assemblies 135 includes a deformable blade 120 coupled to a rigid blade 130. The deformable blade 120 has a radial height that is greater than the radial height of the rigid blade 130. The rigid blade 130 may be configured to stabilize the tubular string in a restriction in the wellbore, while the deformable blade 120 may be configured to stabilize the tubular string in a larger diameter section of the wellbore. In one embodiment, the base of each of the rigid blade 130 and the deformable blade 120 are attached to the outer surface of the tubular body 110. The distal end of the deformable blade 120 is free to bend away from the rigid blade 130. In another embodiment, an optional connector 122 may be used to attach the lower portion of the deformable blade 120 and the rigid blade 130. As shown in FIG. 1A, the connector 122 may be a screw, a nut and bolt, a bond material such as adhesive, or any other suitable connector for connecting the deformable blade 120 to the rigid blade 130. A backing plate 126 attached to the connector 122 may extend longitudinally along the lower portion of the deformable blade 120. In another embodiment, the deformable blade 120 is coupled to the tubular body 110 via the rigid blade 130 and the connector 122. The thickness of the blades 120, 130 may be the same or different. In one embodiment, the deformable blade 120 is thicker than the rigid blade 130. The rigid blade 130 may be made of metal such as steel or metal alloy, a polymer having sufficient stiffness, and combinations thereof. The deformable blade 120 may be made of an elastomer such as polyurethane, rubber, or another suitable polymer or a deformable material. It is contemplated that the blade assembly 135 may be attached directly to the outer surface of the central body 20. This arrangement allows the blade assembly 130 to rotate with the central body 20.

In one embodiment, the deformable blade 120 is positioned in front of the rigid blade 130 relative to the rotational direction of the tubular string during normal operation. With reference to FIG. 1A, the deformable blade 120 is in the front when the tubular string rotates clockwise. In this respect, the rigid blade 130 may provide additional support for the deformable blade 120 during rotation. If the tubular string is rotated in the opposite direction, wherein the rigid blade 130 is located in front of the deformable blade 120, then the deformable blade 120 is allowed to bend away from the rigid blade 130. As a result, the height of the deformable blade 120 is reduced, thereby allowing the tool to move through a restriction.

Figure 1B:
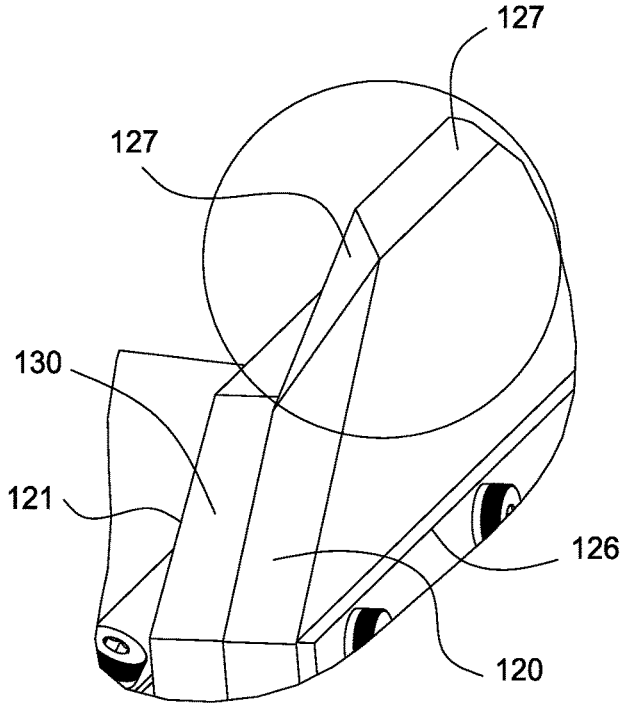
FIG. 1B is an enlarged, partial view of the blades of the stabilizing assembly of FIG. 1.

As shown in FIG. 1, the front edge and the back edge of the deformable blade 120 and the rigid blade 130 have an incline 121. Additionally, the upper portion of the incline edges 121 and the top edge of the deformable blade 120 may have a geometric profile 127 that preferentially bends the deformable blade 120 in one direction when a force is applied, such as encountering a restriction. In one example, the profile 127 may be a skive cut on the edges 121 as shown in FIG. 1B. The skive cut preferentially bends the deformable blade 120 in a direction away from the rigid blade 130 when the geometric profile 127 encounters a restriction. In another embodiment, the geometric profile 127 may be a recess formed in the side of the deformable blade 120 opposite the rigid blade 130. The recess provides a weak area to encourage bending of the deformable blade 120 toward the same side of the deformable blade 120.

In operation, the stabilizing assembly 90 may be run-in hole in the configuration shown in FIG. 1. The central body 20 of the stabilizing assembly 90 may be connected to a tubular string having a cutter. In one example, the tubular string, cutter, and stabilizing assembly 90 can be used to remove a wellhead by passing the cutter and stabilizer 100 through the wellhead and cutting the casing below the wellhead. During the run-in and cutting process, the stabilizer 100 acts to centralize the central body 20 in the wellbore. In the configuration of FIG. 1, the stabilizer 100 does not rotate with the tubular string.

During run-in, the stabilizer 100 may need to pass through a restriction having an inner diameter that is smaller than an inner diameter of the casing below the wellhead. The restriction may be the inner diameter of the wellhead. The stabilizer 100 may be equipped with a plurality of deformable blades 120 configured with an outer diameter for supporting the tubular string in the larger diameter of the casing and a plurality of rigid blades 130 having an outer diameter for passing through and supporting the tubular string in the restriction. The deformable blades 120 are configured to bend sufficiently to allow the stabilizer 100 to pass through the restriction.

Figure 2A:
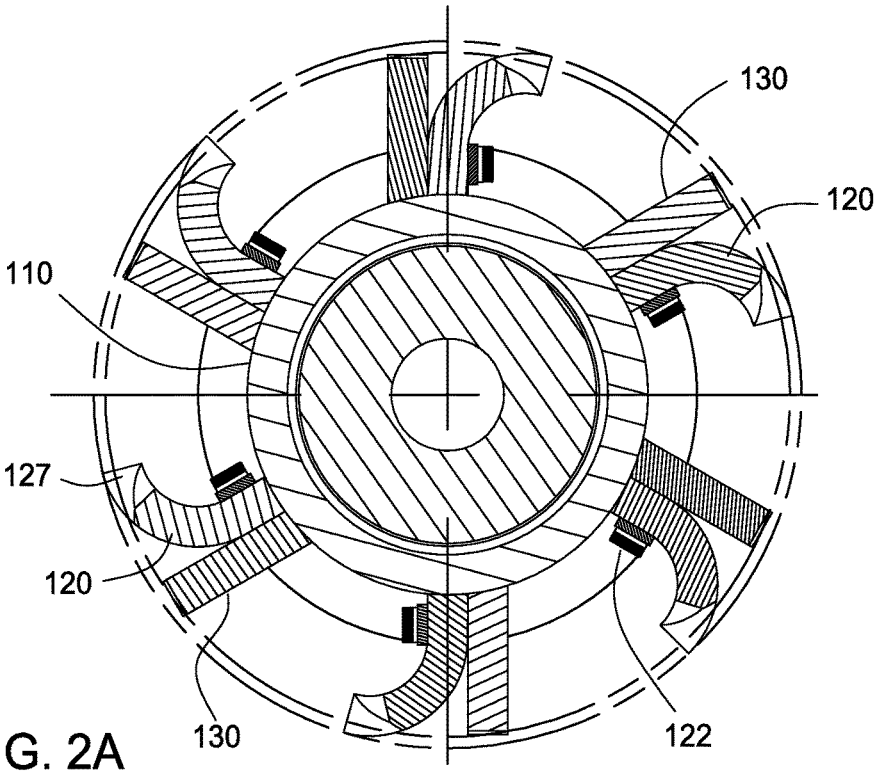
FIG. 2A is a cross-sectional view of the stabilizing assembly of FIG. 2.
Figure 2:
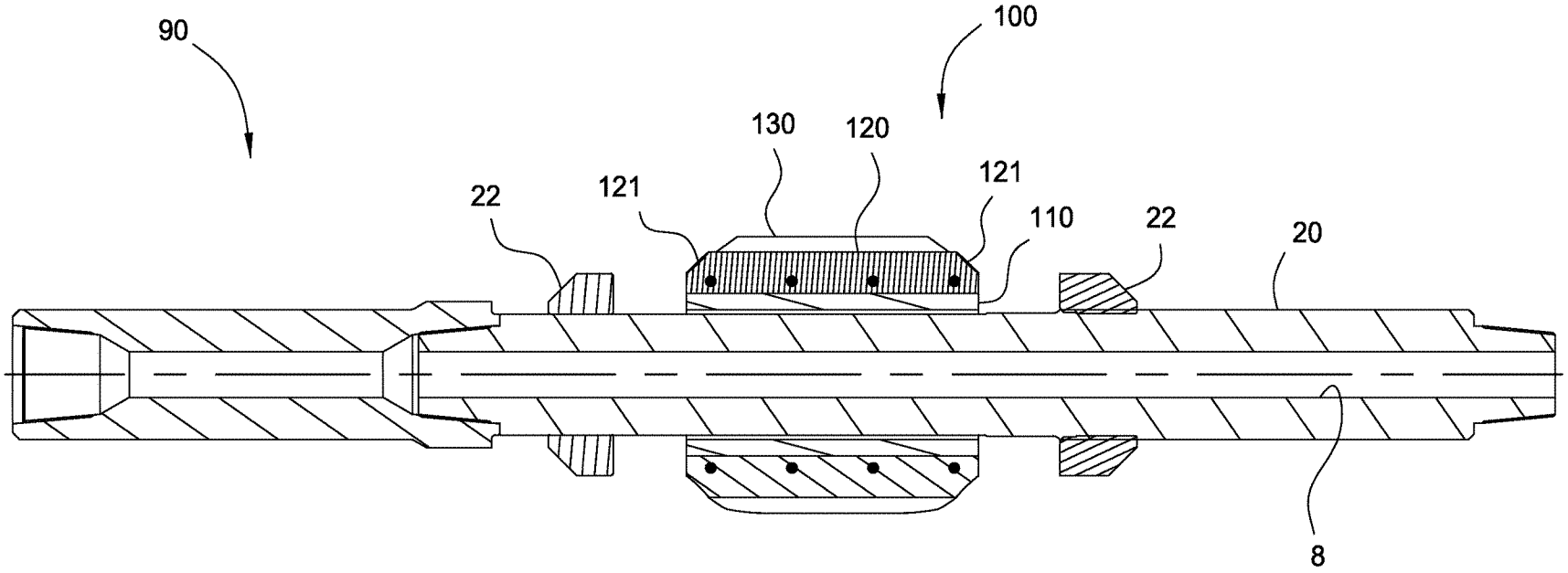
FIG. 2 illustrates a cross-sectional view of the stabilizing assembly of FIG. 1 in a deformed position.

As the stabilizer 100 encounters the restriction, the deformable blades 120 will contact the restriction. Due to the geometric profile 127, the deformable blades 120 will preferentially deflect away from the rigid blade 130, as shown in FIGS. 2 and 2A. The bending of the deformable blades 120 will reduce the overall outer diameter of the stabilizer 100, thereby allowing the stabilizer 100 to pass through the restriction. After passing through the restriction, the deformable blades 120 will return to its original diameter. In this manner, the deformable blades 120 may support the tubular string in the casing.

Figure 3:
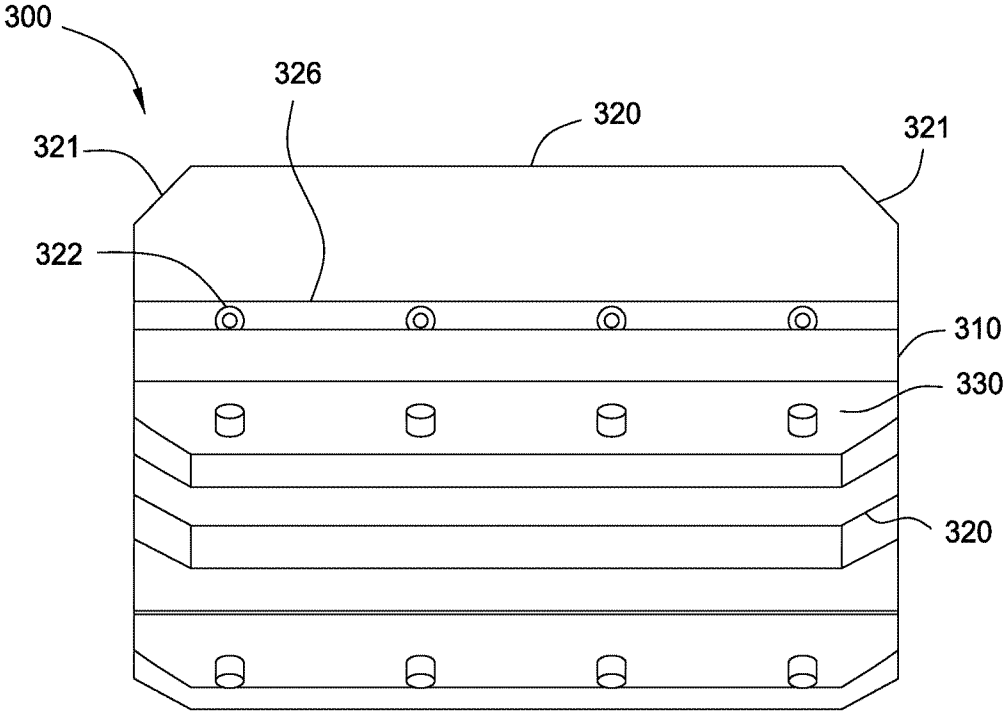
FIGS. 3 and 4 illustrate another embodiment of a stabilizer.
Figure 4:
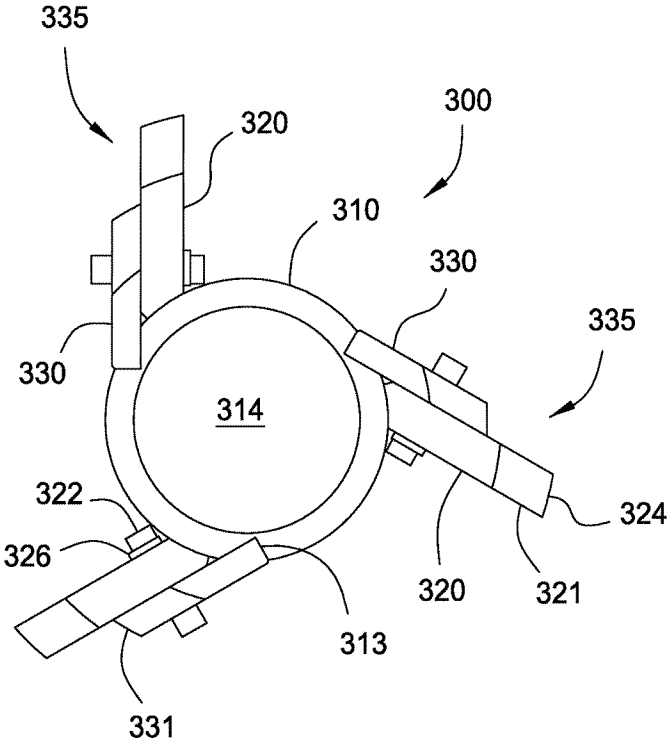

FIGS. 3 and 4 illustrate another embodiment of a stabilizer 300. FIG. 3 is a front view and FIG. 4 is a side view of the stabilizer 300. The stabilizer 300 may be used in the stabilizing assembly 90 instead of the stabilizer 100 as described above. The stabilizer 300 includes a tubular body 310 and a plurality of blades disposed on an outer surface of the tubular body 310. As shown in FIG. 4, the bore 314 of the tubular body 310 is larger than an outer diameter of the central body 20 such that the tubular body 310 is disposable around the central body 20. In this respect, the central body 20 is rotatable relative to the stabilizer 300.

As shown, a plurality of blade assemblies 335 is disposed circumferentially on the tubular body 310. Each of the blade assemblies 335 includes a deformable blade 320 coupled to a rigid blade 330. The rigid blade 330 may be configured to stabilize the tubular string in a restriction in the wellbore, while the deformable blade 320 may be configured to stabilize the tubular string in a larger diameter section of the wellbore. In one embodiment, one or more blade assemblies 335 are parallel to and offset from a radial axis. In FIG. 4, the blade assemblies 335 are positioned in parallel to and offset from a radial axis. In yet another embodiment, one or more blades assemblies 335 are within 15 degrees or within 45 degrees from parallel to and offset from a radial axis. In another embodiment, the blade assemblies 335 are arranged at an angle relative to a radial axis of the tubular body 310. One or more blade assemblies 335 may be positioned between 0 degrees and 75 degrees, between 5 degrees and 75 degrees, between 15 degrees and 75 degrees, between 25 degrees and 75 degrees, and between 35 degrees and 70 degrees relative to a radial axis. In another embodiment, the blade assemblies 335 are positioned between 40 degrees and 60 degrees relative to a radial axis. Without wishing to be bound by theory, it is believed the offset position or the angle position of the blade assemblies 335 facilitate bending of the deformable blade 320 when a restriction is encountered. In this respect, the overall outer diameter of the stabilizer 300 is reduced when the deformable blade 320 bends away from the rigid blade 330.

Figure 5C:
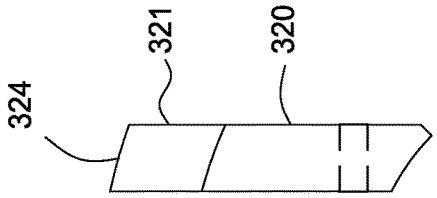
FIGS. 5A-C are the front view, side view, and top view, respectively, of an exemplary deformable blade.
Figure 5B:
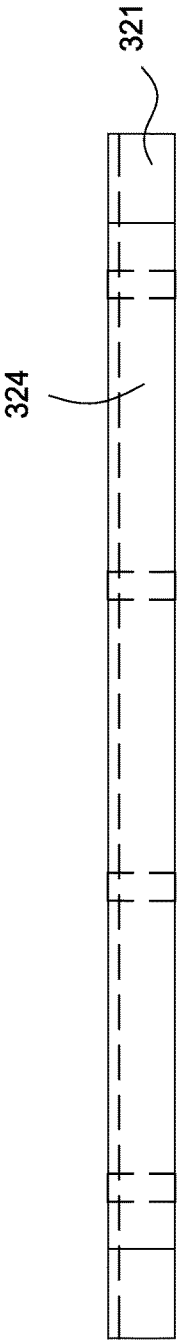
Figure 5A:
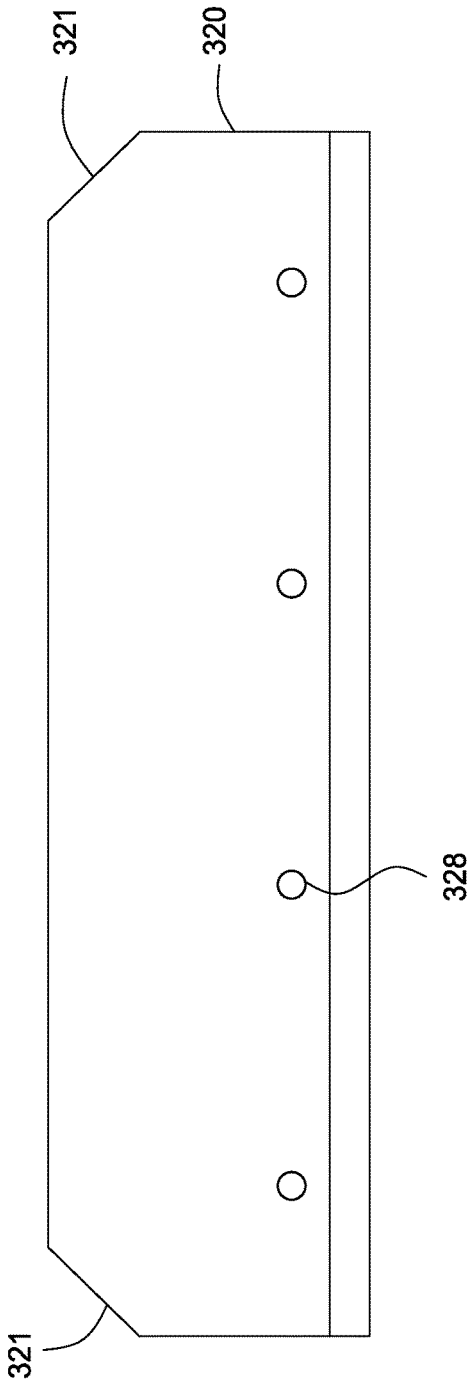
Figure 6B:
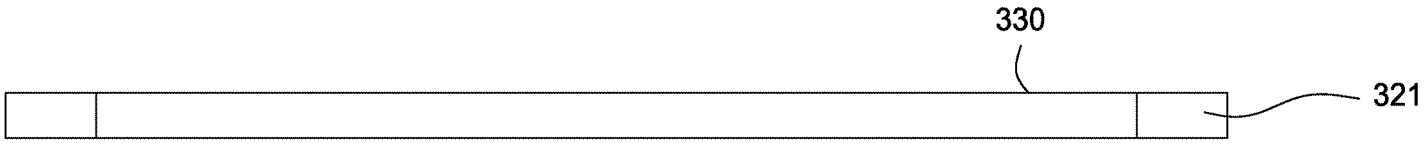
FIGS. 6A-C are the front view, side view, and top view, respectively, of an exemplary rigid blade.
Figure 6C:
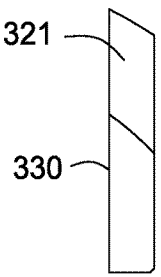
Figure 6A:
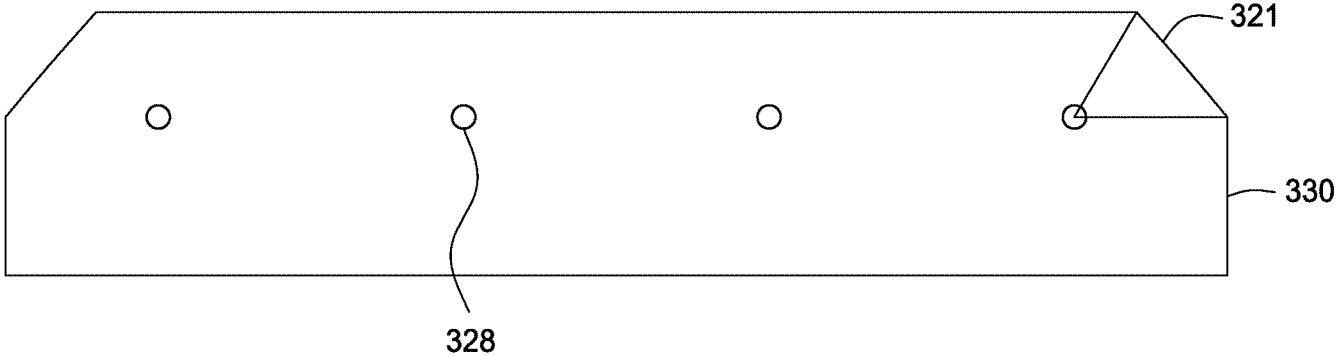

FIGS. 5A-C are the front view, side view, and top view, respectively, of an exemplary deformable blade 320. FIGS. 6A-C are the front view, side view, and top view, respectively, of an exemplary rigid blade 330. The deformable blade 320 has a radial height that is greater than the radial height of the rigid blade 330. The base of each of the rigid blade 330 and the deformable blade 320 may be attached to the outer surface of the tubular body 310. In another embodiment, at least one of the deformable blade 320 and the rigid blade 330 may be attached to a recess in the tubular body 310. As shown in FIG. 3, the rigid blade 330 is attached to a recess 313 in the tubular body 310 and the deformable blade 320 is attached to the surface of the tubular body 310. The bottom surface of the deformable blade 320 may complement the outer surface of tubular body 310 to facilitate attachment, as shown in FIG. 5C. The distal end 324 of the deformable blade 320 may have an arcuate diameter that matches the casing in which the deformable blade 320 is to be used. The distal end 331 of the rigid blade 330 may have an arcuate diameter that matches the restriction in which the rigid blade 330 is to pass through. In another embodiment, the distal end 324, 331 of at least one of the deformable blade 320 and the rigid blade 330 may have a bevel that between 20 degrees and 75 degrees or between 25 and 65 degrees relative to a radial axis. The arcuate or bevel shape at the distal end may reduce any incidental contact down hole. As shown in FIGS. 3, 5A, and 6A, the front edge and the back edge of the deformable blade 320 and the rigid blade 330 have an incline 321. The incline 321 may facilitate movement of the stabilizer 330 through the casing or restriction.

In another embodiment, an optional connector 322 may be used to attach the lower portion of the deformable blade 320 and the rigid blade 330. As shown in FIGS. 3 and 4, the connector 322 may be a screw, a nut and bolt, a bond material such as adhesive, or any other suitable connector for connecting the deformable blade 320 to the rigid blade 330. The deformable blade 320 and the rigid blade 330 include a plurality of apertures 328 for accommodating the connector 322. A backing plate 326 attached to the connector 322 may extend longitudinally along the lower portion of the deformable blade 320. In another embodiment, the deformable blade 320 is coupled to the tubular body 310 via the rigid blade 330 and the connector 322. The thickness of the blades 320, 330 may be the same or different. In one embodiment, the deformable blade 320 is thicker than the rigid blade 330. The rigid blade 330 may be made of metal such as steel or metal alloy, a polymer having sufficient stiffness, and combinations thereof. The deformable blade 320 may be made of an elastomer such as polyurethane, rubber, or another suitable polymer or a deformable material. It is contemplated that the blade assembly 335 may be attached directly to the outer surface of the central body 20. This arrangement allows the blade assembly 330 to rotate with the central body 20.

In one embodiment, the deformable blade 320 is positioned in front of the rigid blade 330 relative to the rotational direction of the tubular string during normal operation. With reference to FIG. 3, the deformable blade 320 is in the front when the tubular string rotates clockwise. In this respect, the rigid blade 330 may provide additional support for the deformable blade 320 during rotation. If the tubular string is rotated in the opposite direction, wherein the rigid blade 330 is located in front of the deformable blade 320, then the deformable blade 320 is allowed to bend away from the rigid blade 330. As a result, the height of the deformable blade 320 is reduced, thereby allowing the tool to move through a restriction.

In operation, a stabilizing assembly is formed by coupling the stabilizer 300 with the central body 20. The central body 20 of the stabilizing assembly may be connected to a tubular string having a cutter. In one example, the tubular string, cutter, and stabilizing assembly can be used to remove a wellhead by passing the cutter and stabilizer 300 through the wellhead and cutting the casing below the wellhead. During the run-in and cutting process, the stabilizer 300 acts to centralize the central body 20 in the wellbore. If used in the configuration of FIG. 1, the stabilizer 300 does not rotate with the tubular string.

During run-in, the stabilizer 300 may need to pass through a restriction having an inner diameter that is smaller than an inner diameter of the casing below the wellhead. The restriction may be the inner diameter of the wellhead. The stabilizer 300 is equipped with a plurality of deformable blades 320 configured to support the tubular string in the larger diameter of the casing and a plurality of rigid blades 330 having an outer diameter capable of passing through and supporting the tubular string in the restriction. The deformable blades 320 are configured to bend sufficiently to allow the stabilizer 300 to pass through the restriction. As shown in FIG. 4, the deformable blades 320 are positioned at an offset relative to a radial axis to facilitate deformation of the deformable blades 32.

Figure 7:
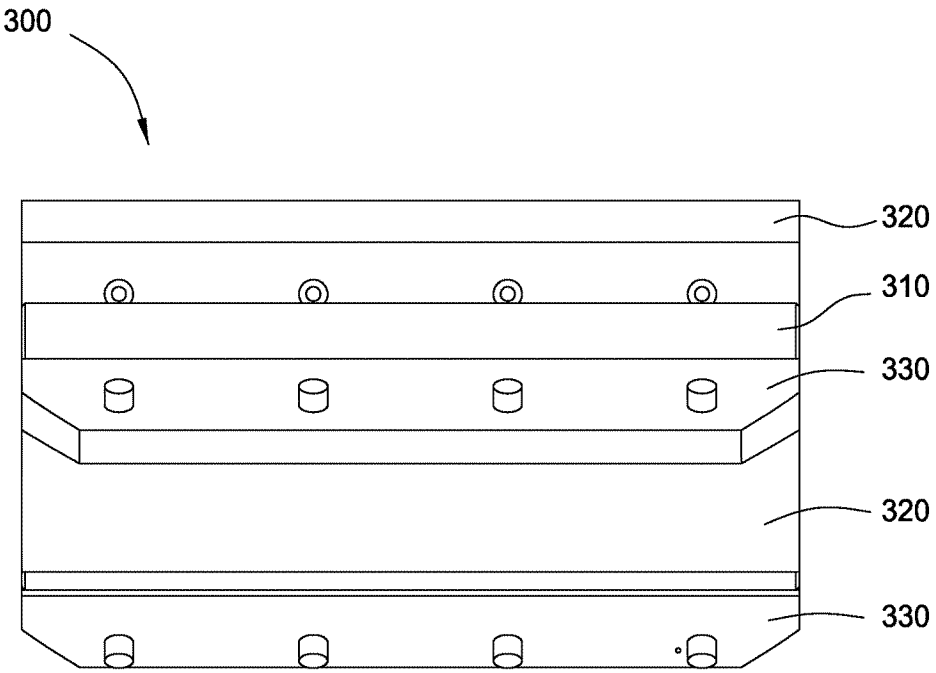
FIG. 7 is a front view and FIG. 8 is a side view of the stabilizer of FIG. 3 in a reduced diameter state.
Figure 8:
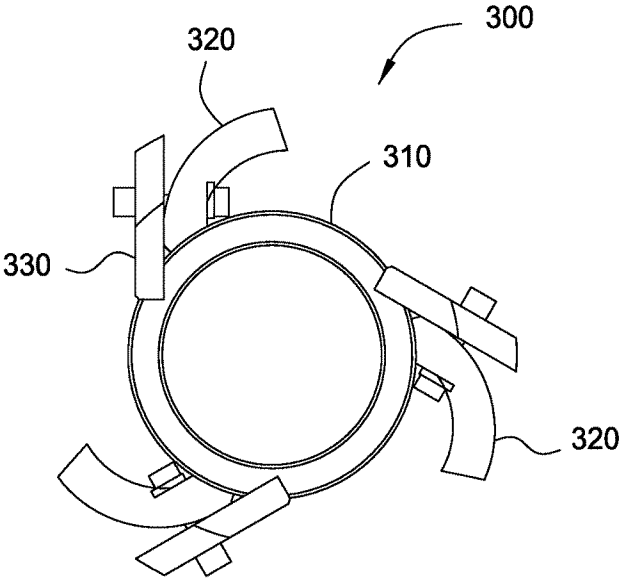

When the stabilizer 300 contacts the restriction, the deformable blades 320 will be urged against the restriction. Due to the offset arrangement of the deformable blades 320, the deformable blades 320 will preferentially deflect away from the rigid blade 330, as shown in FIGS. 7 and 8. FIG. 7 is a front view and FIG. 8 is a side view of the stabilizer 300 with a reduced outer diameter, which is shown without the central body 20 and the restriction. The bending of the deformable blades 320 will reduce the overall outer diameter of the stabilizer 300, thereby allowing the stabilizer 300 to pass through the restriction. The rigid blades 330 will support the stabilizer 300 in the restriction as the stabilizer 300 moves through the restriction. After passing through the restriction, the deformable blades 320 will return to its original diameter. In this manner, the deformable blades 320 may support the tubular string in the casing.

Figure 8B:
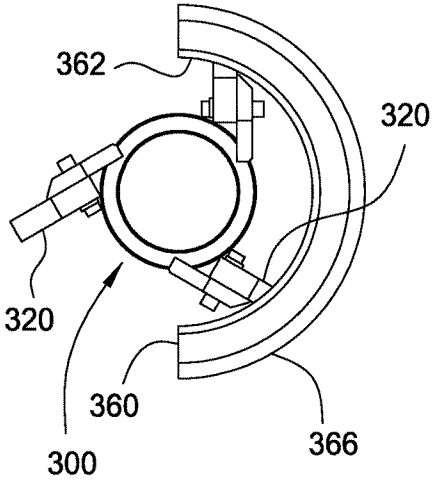
FIGS. 8A and 8B illustrate a stabilizer disposed within a tubular having a restriction.
Figure 8A:
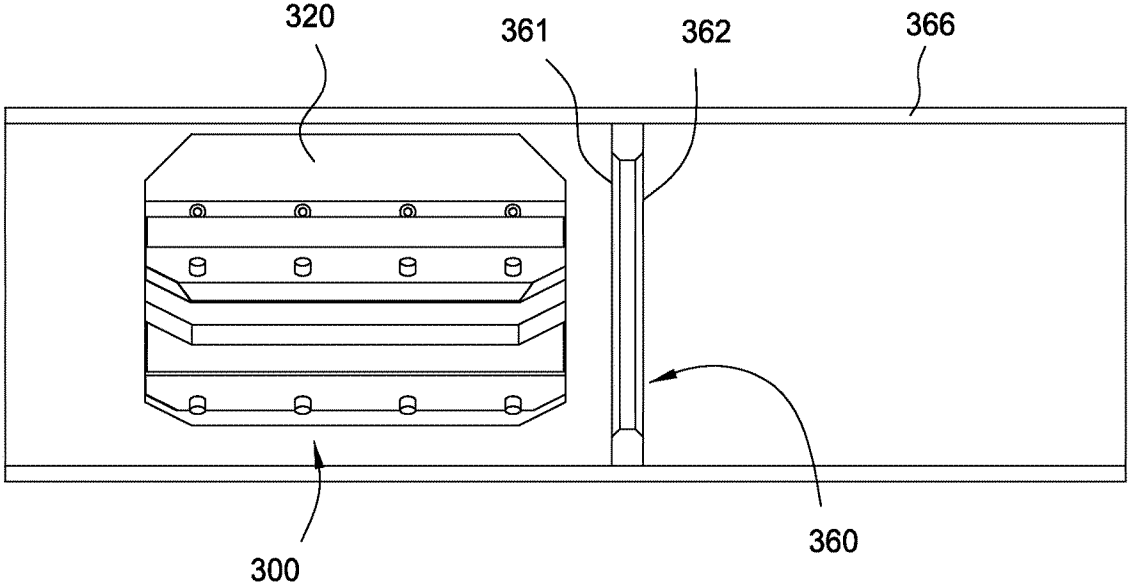

In another embodiment, the restriction may be configured to facilitate deflection of the deformable blades 320. For example, a bevel is provided on the wellhead restriction for contacting the deformable blades 320. FIGS. 8A and 8B illustrate an exemplary stabilizer 300 disposed within a tubular 366 having a restriction 360. The tubular may be a wellhead or a wellbore. As shown, the restriction 360 includes a bevel 361, 362 on one or both sides of the restriction 360. The angle of the bevel 361, 362 will force the deformable blades 320 towards the center of the restriction 360. As a result, the deformable blades 320 will bend toward the center, away from the rigid blades 330, when the restriction 360 is encountered. Because of the offset or angled positioning of the deformable blades 320, the deformable blades 320 will bend more easily upon contact with the bevel 361, 362 of the restriction 360.

Figure 10:
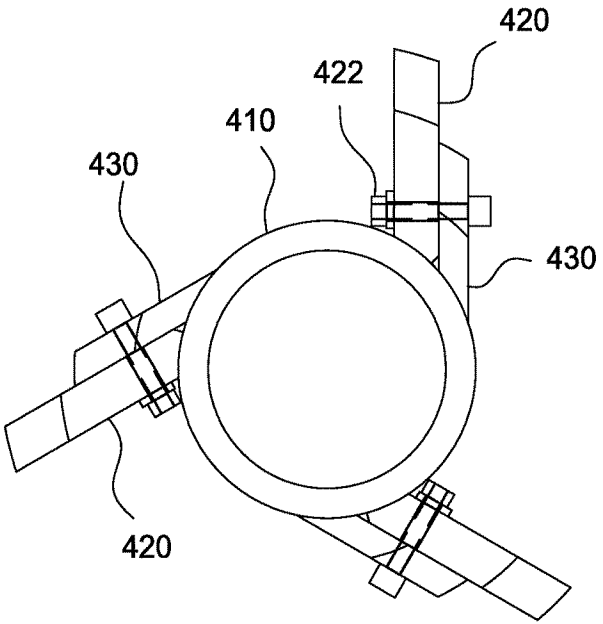
FIGS. 9 and 10 illustrate another embodiment of the stabilizer.
Figure 9:
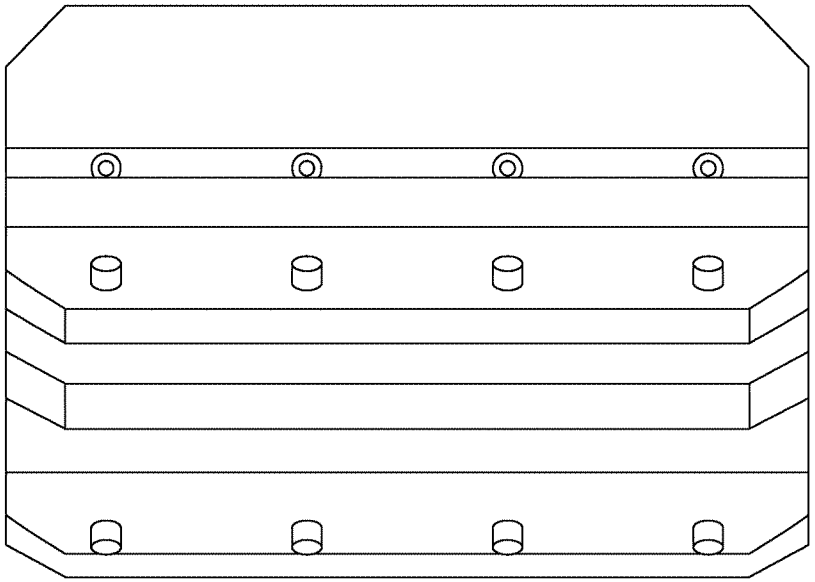

FIGS. 9 and 10 illustrate another embodiment of the stabilizer 400. FIG. 9 is a front view and FIG. 10 is a side view of the stabilizer 400. As shown, the stabilizer 400 is configured for left hand rotation. In this embodiment, the deformable blade 420 is in front of the rigid blade 430 when the tubular string rotates counterclockwise. In this respect, the rigid blade 430 may provide additional support for the deformable blade 420 during rotation. If the tubular string is rotated in the opposite direction, wherein the rigid blade 430 is located in front of the deformable blade 420, then the deformable blade 420 is allowed to bend away from the rigid blade 430. As a result, the height of the deformable blade 420 is reduced, thereby allowing the stabilizer 400 to move through a restriction. FIG. 10 shows the deformable and rigid blades 420, 430 are attached to the outer surface of the tubular body 410, although one or both blades 420, 430 may be attached to a recess in the tubular body 410. The blades 420, 430 are attached to each other using a plurality of connectors 422.

Figure 11C:
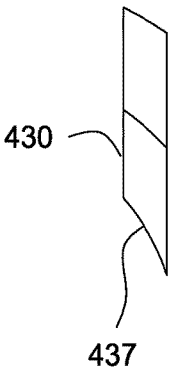
FIGS. 11A-C are the front view, side view, and top view, respectively, of an exemplary rigid blade.
Figure 11B:
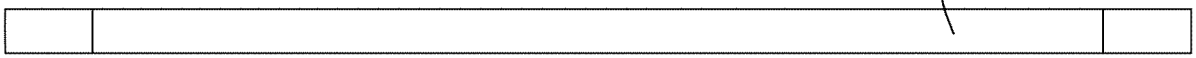
Figure 11A:
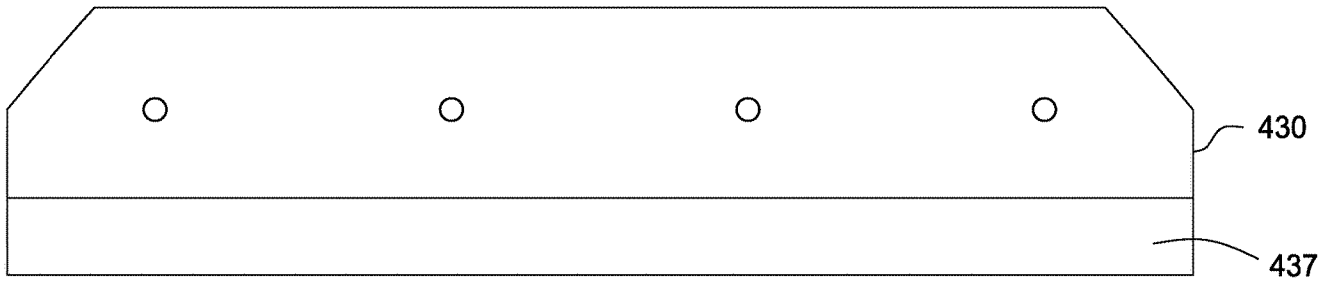

FIGS. 11A-C are the front view, side view, and top view, respectively, of an exemplary rigid blade 430. The bottom surface 437 of the rigid blade 430 is configured to complement the outer surface of tubular body 310 to facilitate attachment, as shown in FIG. 11C.

Figure 12:
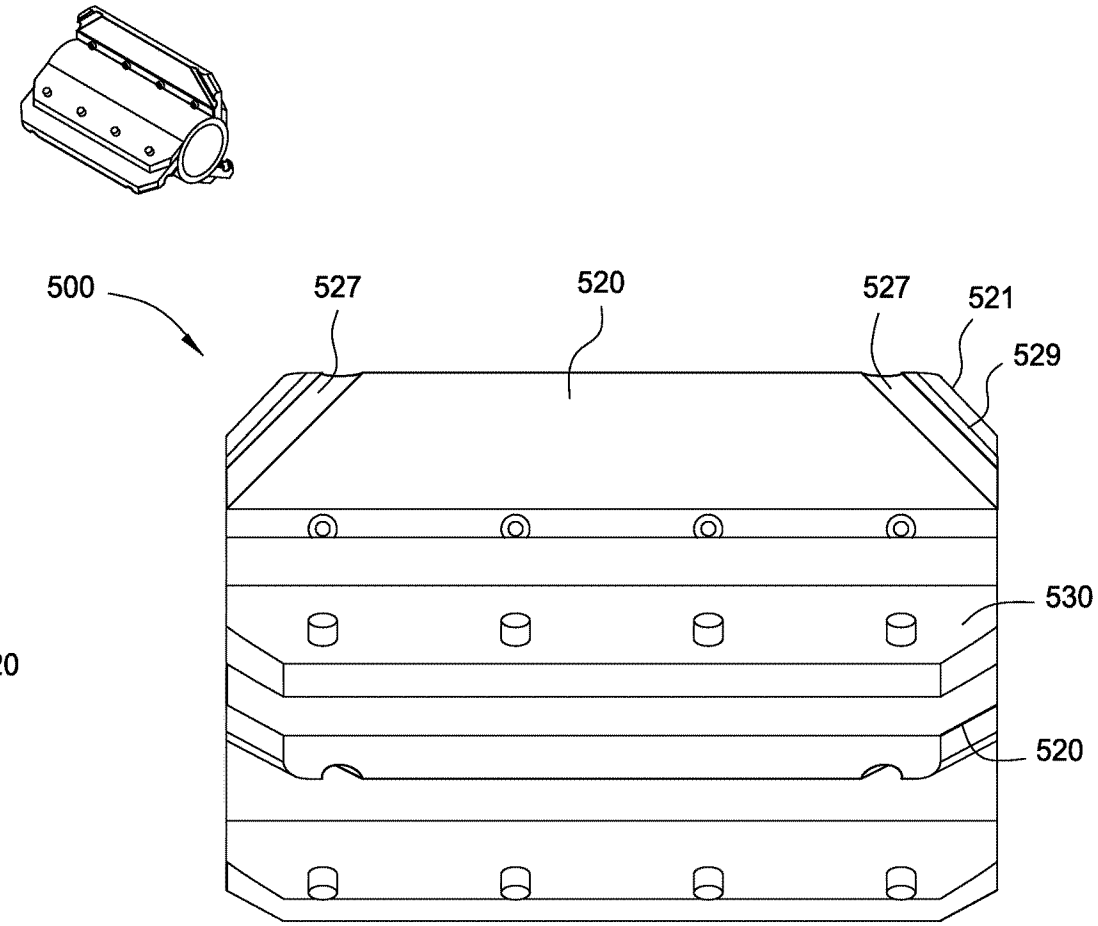
FIGS. 12-13 illustrate another embodiment of a deformable blade suitable for use with a stabilizer.
Figure 13:
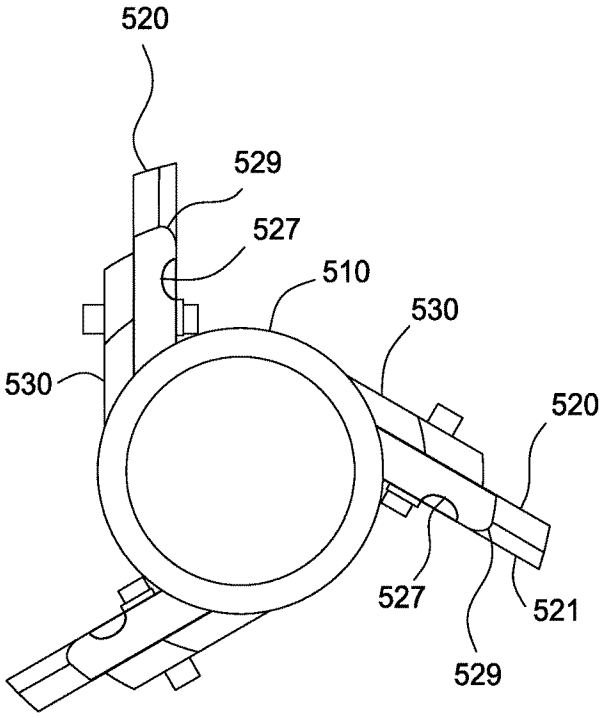
Figure 14B:
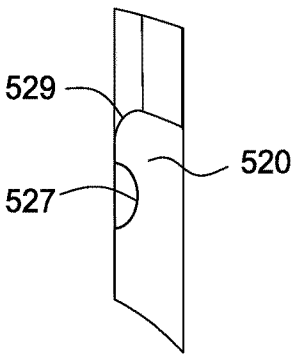
FIGS. 14A-C are the front view, side view, and top view, respectively, of the deformable blade of FIG. 12.
Figure 14C:
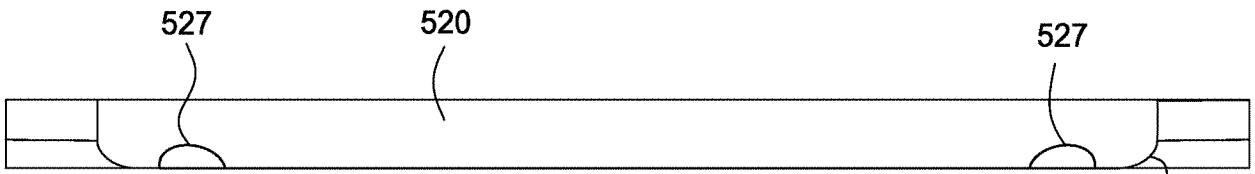
Figure 14A:
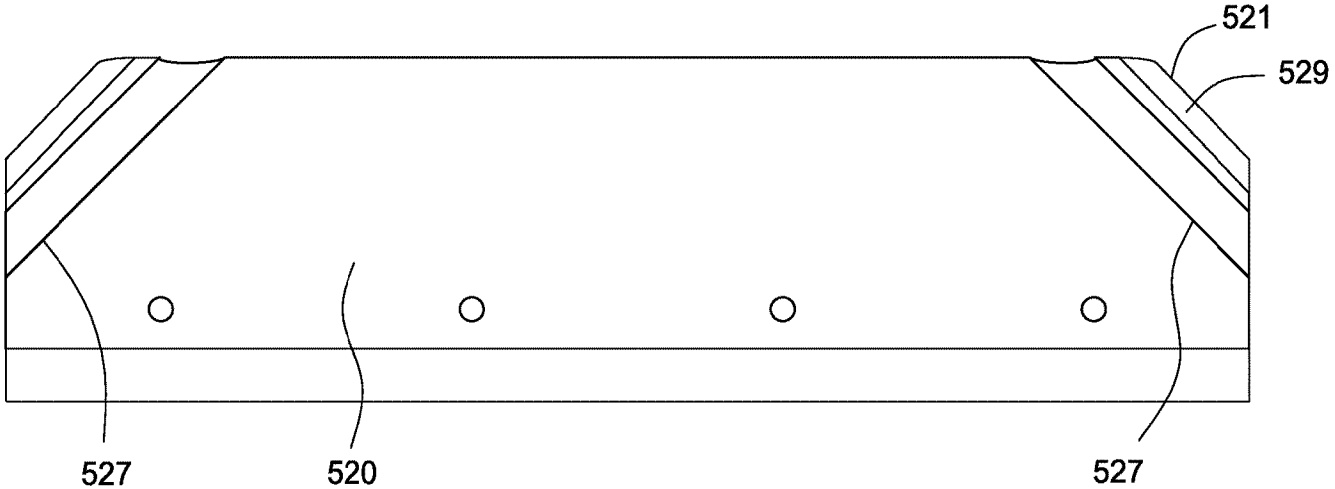

FIGS. 12-14 illustrate another embodiment of a deformable blade 520 suitable for use with a stabilizer 500. FIGS. 12 and 13 are a front view and a side view, respectively, of the stabilizer 500. FIGS. 14A-C are the front view, side view, and top view, respectively, of the deformable blade 520. In this embodiment, the deformable blade 520 may include a recess 527 formed in the front surface of the deformable blade 520. The recess 527 provides a weak area to encourage bending of the deformable blade 520 toward the front of the deformable blade 520 and away from the rigid blade 530. An exemplary recess 527 is a groove. In one example, the recess 527 is formed at an angle relative to a longitudinal axis of the stabilizer 500. The angle relative to the longitudinal axis may be between 0 degrees and 60 degrees, between 15 degrees and 50 degrees, and between 25 degrees and 50 degrees. As shown, the recess 527 is positioned at a 45 degree angle relative to the longitudinal axis. The recess 527 extends from a side surface of the deformable blade 520 to the top surface of the deformable blade 520. The recess 527 may be formed at both sides of the deformable blade 520.

In another example, as shown in FIGS. 15A-C, the recess 582 extends partially into the deformable blade 580. FIGS. 15A-C are the front view, side view, and top view, respectively, of the deformable blade 580. In this example, the recess 582 extends along the longitudinal axis the deformable blade 580. As shown, the recess 582 is substantially parallel to the longitudinal axis, although the recess 582 may be angled as discussed above. The recess 582 may extend between 10% and 75% of the length of the deformable blade 580. In one example, the length of the recess 582 is between 15% and 45% of the length of the deformable blade 580. In another example, the length of the recess 582 is between 0.5 in. to 8 in. and between 1 in. and 7 in. The recess 582 may be formed at one or both sides of the deformable blade 580.

Figure 16C:
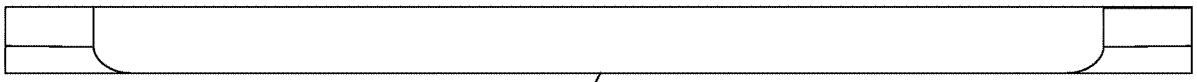
FIGS. 16A-C illustrate another example of a deformable blade.
Figure 16A:
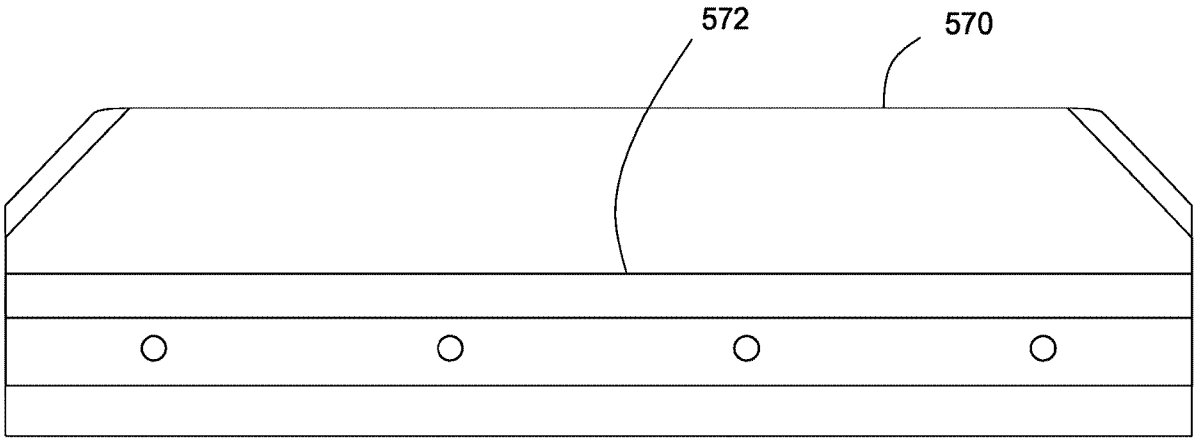
Figure 16B:
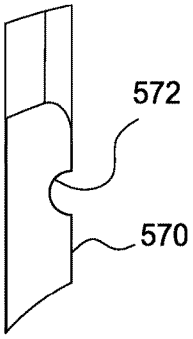

FIGS. 16A-C illustrate another example of a deformable blade 570 suitable for use with a stabilizer 500. FIGS. 16A-C are the front view, side view, and top view, respectively, of the deformable blade 570. In this embodiment, the recess 572 extends the entire length of the deformable blade 570. The recess 572 provides a weak area to encourage bending of the deformable blade 570 toward the front of the deformable blade 570. As shown, the recess 572 may be formed below the incline surface 521. In another embodiment, the recess 572 may be formed at a location that allows the deformable blade 570 to bend sufficiently to pass through the restriction.

In one embodiment, the recess 527 has a diameter that is between 10% and 75% of the thickness of the deformable blade 520. In one example, the recess 527 has a diameter that is between 20% and 55% of the thickness of the deformable blade 520. In another example, the recess 527 has a diameter that is between 0.25 in. and 1.5 in., preferably, between 0.4 in. and 1.1 in. In another embodiment, the front edge 529 of the angled incline 521 may be beveled, as shown in FIGS. 13, 14A, and 14B. In FIG. 13, the rigid blade 530 is attached to the outer surface of the tubular body 510, although either blade 520, 530 may be attached to a recess 513 in the tubular body 510.

Figure 17:
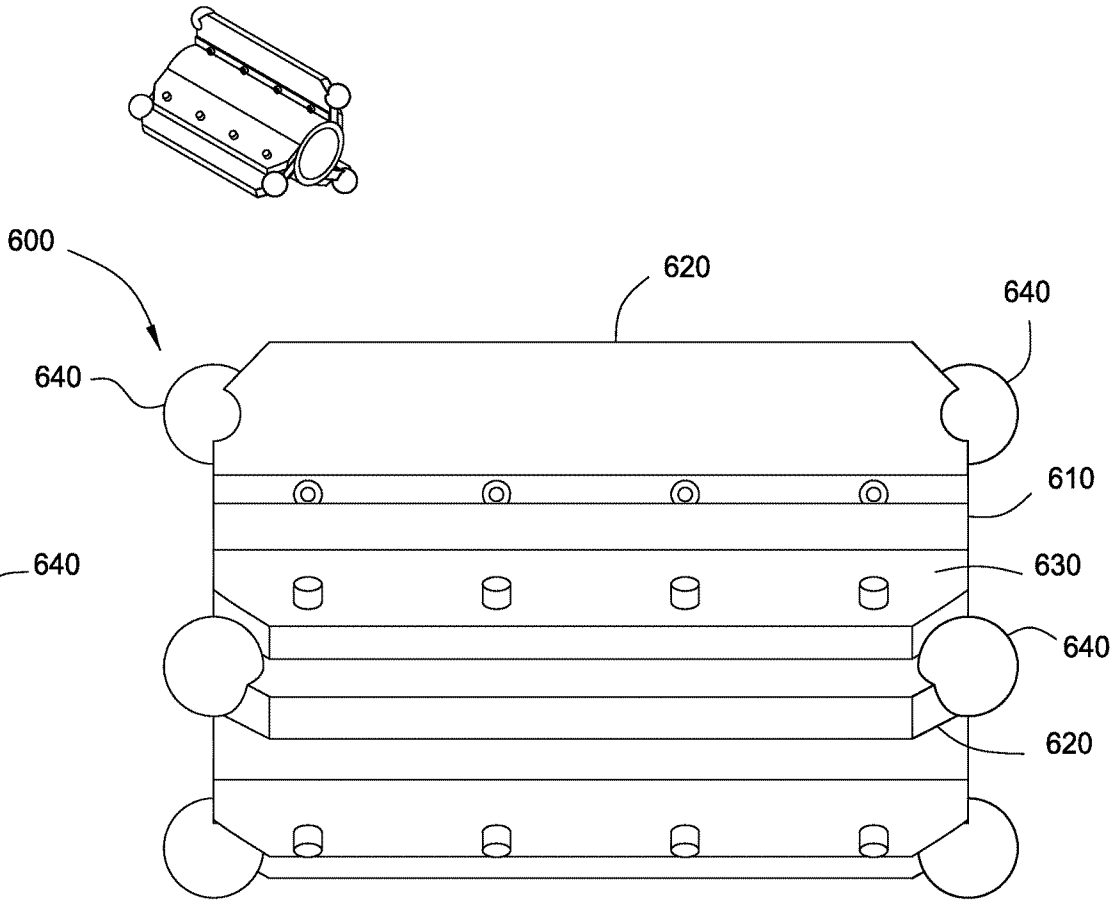
FIGS. 17-18 illustrate another embodiment of a stabilizer.
Figure 18:
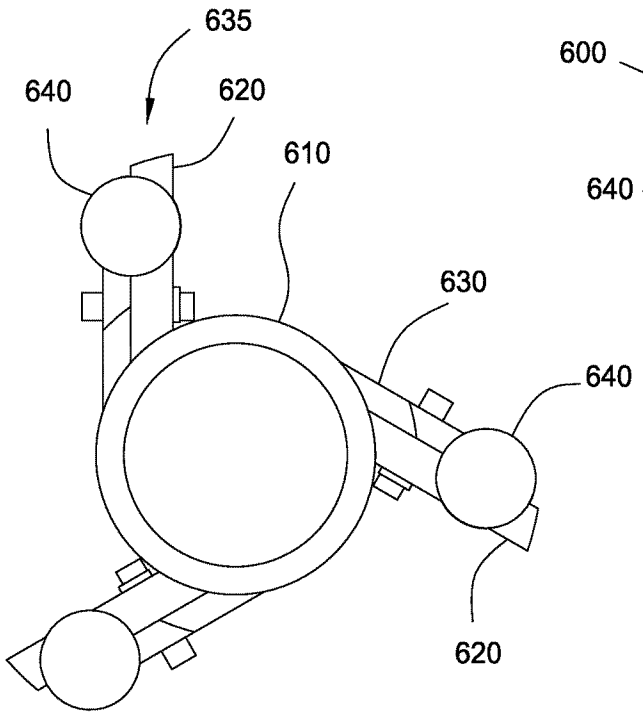
Figure 19B:
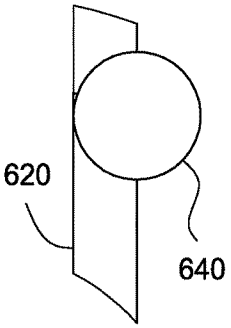
FIGS. 19A-C are the front view, side view, and top view, respectively, of the deformable blade of FIG. 18.
Figure 19C:
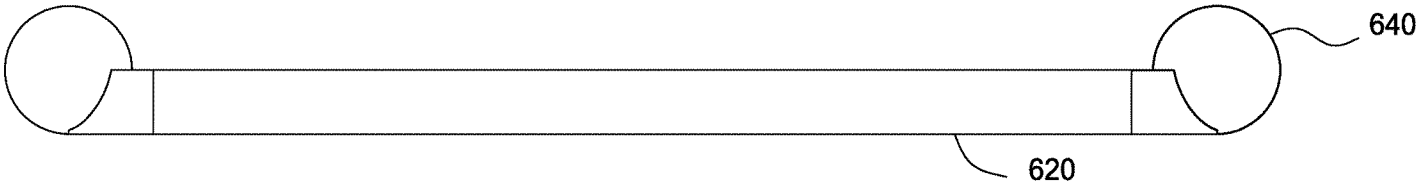
Figure 19A:
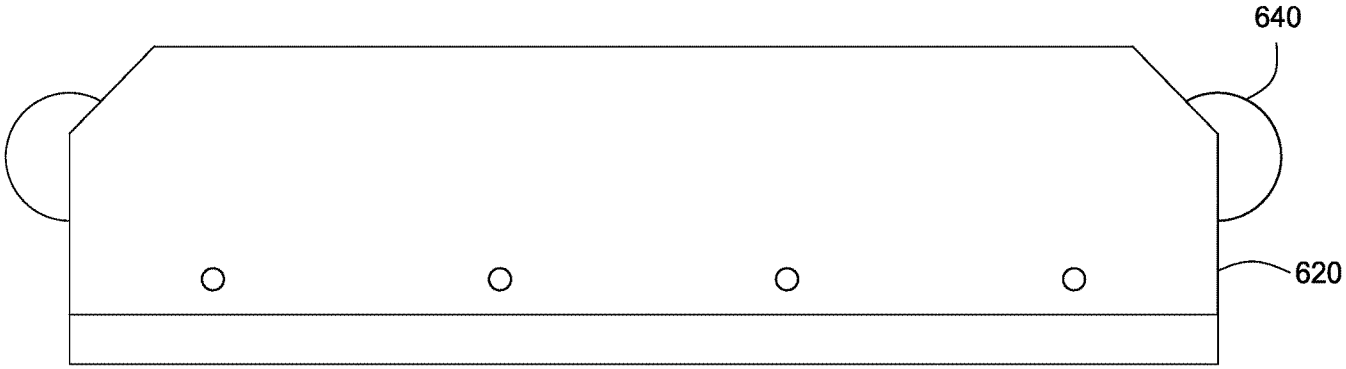
Figure 20:
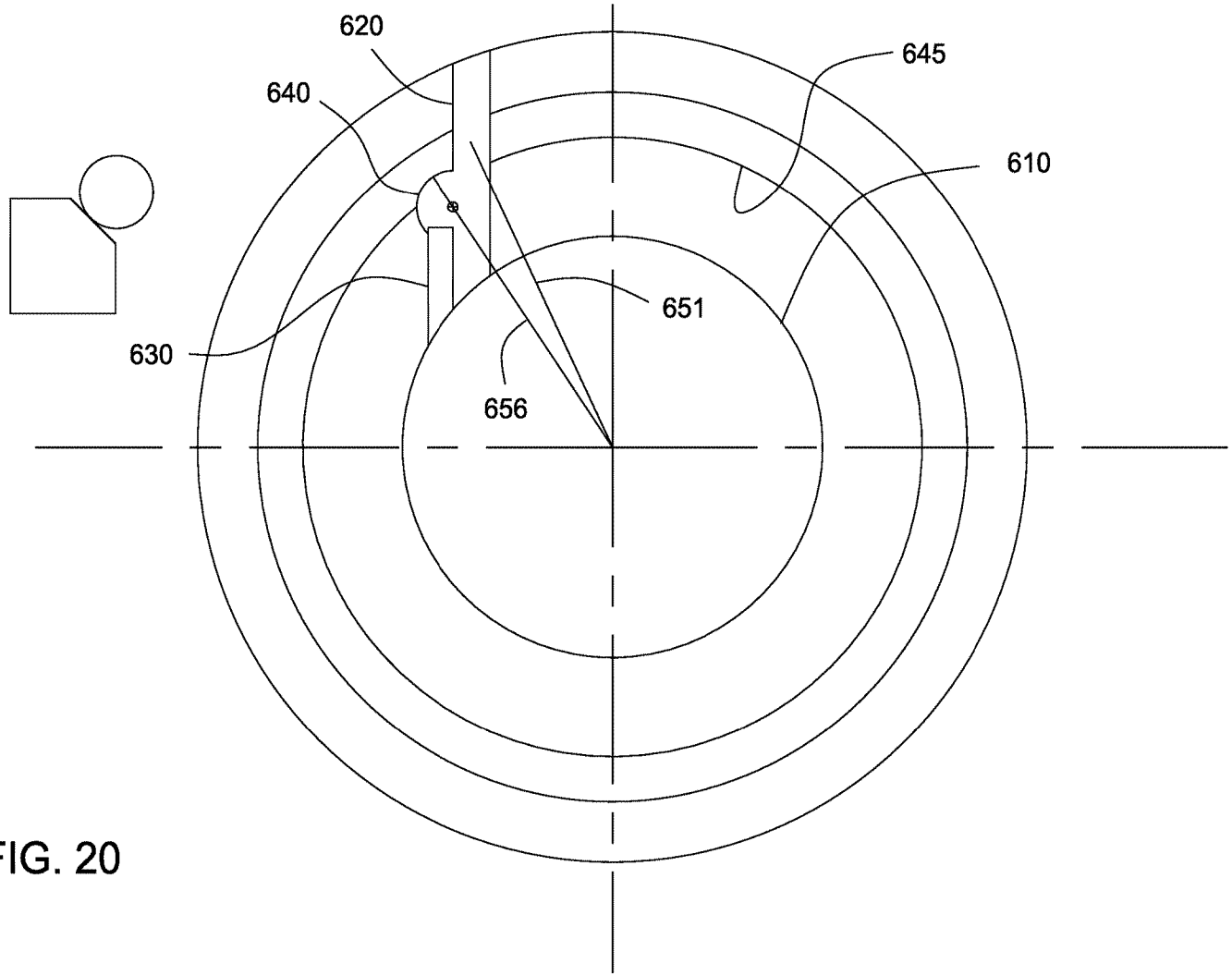
FIG. 20 shows the position of the ball relative to the restriction.

FIGS. 17-19 illustrate another embodiment of a stabilizer 600. FIGS. 17 and 18 are a front view and a side view, respectively, of the stabilizer 600. FIGS. 19A-C are the front view, side view, and top view, respectively, of the deformable blade 620. As shown, a plurality of blade assemblies 635 is disposed circumferentially on the tubular body 610. Each of the blade assemblies 635 includes a deformable blade 620 coupled to a rigid blade 630. The rigid blade 630 may be configured to stabilize the tubular string in a restriction in the wellbore, while the deformable blade 620 may be configured to stabilize the tubular string in a larger diameter section of the wellbore. The one or more blade assemblies 635 may be offset from a radial axis or arranged at an angle relative to a radial axis of the tubular body 610. In this embodiment, a ball 640 is attached to the deformable blade 620 to facilitate bending of the deformable blade 620 as it passes through a restriction. The ball 640 is attached to the back surface and at the side of the deformable blade 620. As shown in FIG. 20, the ball 640 is located at a distance where the ball 640 can contact the restriction 645. Also, the centroid of the ball 640 is located inside the inner diameter of the restriction 645. The arrangement of the ball 640 increases the offset at the point of contact. Line 656 represents the direction of the force for a blade 620 with a ball 640 configuration, and line 651 represents the direction of the force for a blade 620 without a ball configuration. In this respect, the ball 640 enhances the effect of the offset to promote bending of the deformable blade 620. In one embodiment, the ball 640 has a radius that is between 25% and 75% of the thickness of the deformable blade 620. In one embodiment, a ball 640 is disposed at the up hole and the down hole sides of the deformable blade 620.

Figure 21:
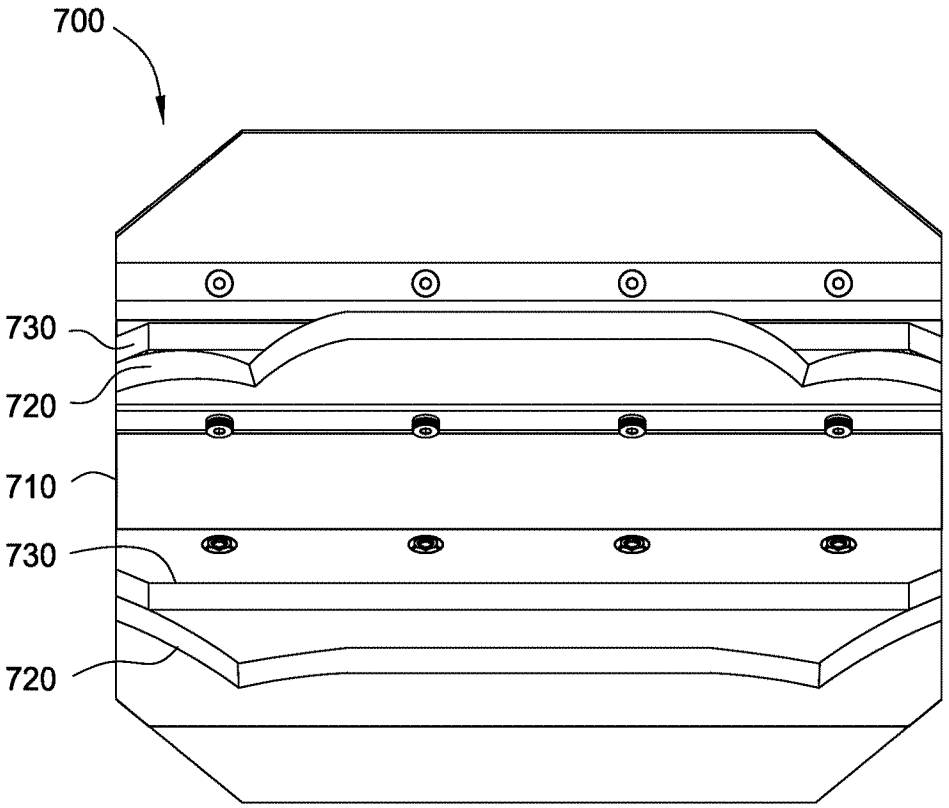
FIGS. 21 and 22 illustrate another embodiment of a stabilizer.
Figure 22:
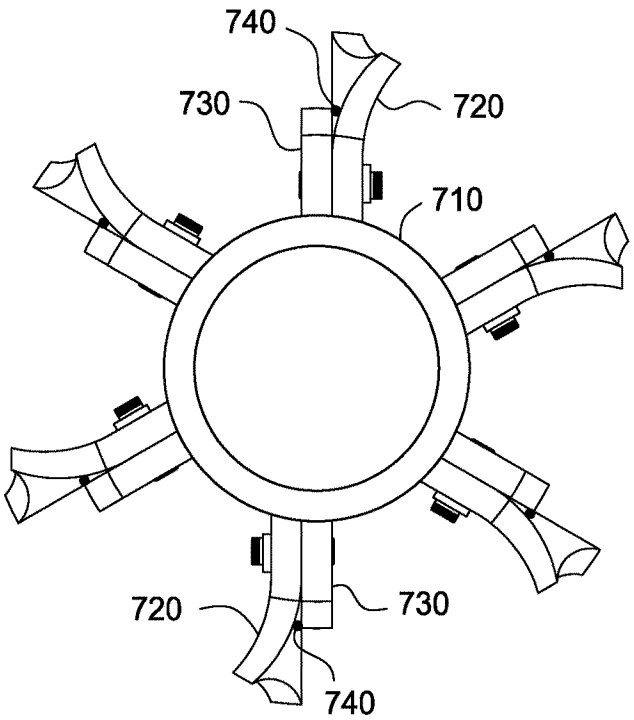

FIGS. 21 and 22 illustrate another embodiment of a stabilizer 700. FIGS. 21 and 22 are a front view and a side view, respectively, of the stabilizer 700. As shown, a plurality of blade assemblies 735 is disposed circumferentially on the tubular body 710. Each of the blade assemblies 735 includes a deformable blade 720 coupled to a rigid blade 730. The rigid blade 730 may be configured to stabilize the tubular string in a restriction in the wellbore, while the deformable blade 720 may be configured to stabilize the tubular string in a larger diameter section of the wellbore. In this embodiment, a deflecting member 740 is attached to the deformable blade 720 to facilitate bending of the deformable blade 720 as it passes through a restriction. The deflecting member 740 is attached to the back surface of the deformable blade 720 and disposed between the deformable blade 720 and the rigid blade 730. As shown in FIG. 21, the deflecting member 740 is a raised member such as a bump disposed between the two blades 720, 730 and in the front portion of the deformable blade 720. The bump 740 has deflected the front portion of the deformable blade 720 away from the rigid blade 730. In this respect, the deflecting member 740 promotes bending of the deformable blades 720 when a restriction is encountered. Optionally, a deflecting member 740 may be provided in the back portion of the deformable blade 720. FIG. 21 shows the front portion and the back portion being deflected by a deflecting member 740. Exemplary deflecting members 740 include a biasing member such as a spring, a ball, a wedge, or other suitable objects configured to deflect the deformable blade 720 away from the rigid blade 730. In this embodiment, the one or more blade assemblies 735 may be aligned with a radial axis, offset from a radial axis, or arranged at an angle relative to a radial axis of the tubular body 710. In FIG. 22, the rigid blade 730 is aligned with a radial axis. Alternatively, the deformable blade 720 may be aligned with the radial axis.

In one embodiment, a stabilizer for passing through a restriction includes a tubular body having a bore therethrough; a rigid blade disposed on the tubular body; and a deformable blade disposed on the tubular body, wherein an outer diameter of the deformable blade is larger than an outer diameter of the rigid blade.

In another embodiment, a stabilizer for passing through a restriction includes a tubular body having a bore therethrough; a rigid blade disposed on the tubular body; and a deformable blade disposed on the tubular body, wherein the deformable blade includes a geometric profile configured to preferentially bend the deformable blade in one direction when the deformable blade encounters the restriction, and wherein the deformable blade has a height greater than a height of the rigid blade.

In another embodiment, a stabilizing assembly for passing through a restriction includes a central body having a bore therethrough; a first collar coupled to the central body; a second collar coupled to the central body; a tubular body disposed around the central body; a rigid blade disposed on the tubular body; and a deformable blade disposed on the tubular body, wherein the deformable blade has a height greater than a height of the rigid blade.

In another embodiment, a method of running a stabilizer coupled to a tubular string through a restriction includes coupling the stabilizer to the tubular string, bending a deformable blade of the stabilizer in response to contacting the restriction, thereby reducing the outer diameter of the deformable blade; moving the stabilizer past the restriction; and allowing the deformable blade to return to its original diameter. In one embodiment, the stabilizer includes a tubular body having a bore therethrough; a rigid blade disposed on the tubular body; and a deformable blade disposed on the tubular body, wherein the deformable blade has an outer diameter larger than an outer diameter of the rigid blade.

In another embodiment, a method of removing a wellhead connected to a casing includes coupling a stabilizer to a tubular string having a cutter, bending a deformable blade of the stabilizer as the stabilizer passes through the wellhead; and separating the wellhead from the casing using the cutter. In one embodiment, the stabilizer includes a tubular body having a bore therethrough; a rigid blade disposed on the tubular body; and a deformable blade disposed on the tubular body, wherein the deformable blade has an outer diameter larger than an outer diameter of the rigid blade.

In one or more of the embodiments described herein, the deformable blade is positioned at an offset relative to a radial axis.

In one or more of the embodiments described herein, the deformable blade is positioned at an angle relative to a radial axis.

In one or more of the embodiments described herein, the deformable blade is positioned at an angle between 25 degrees and 75 degrees relative to a radial axis.

In one or more of the embodiments described herein, the deformable blade includes a recess.

In one or more of the embodiments described herein, the recess is positioned at an angle.

In one or more of the embodiments described herein, the recess has a length that is between 10% and 70% of the length of the deformable blade.

In one or more of the embodiments described herein, a ball is attached to the deformable blade.

In one or more of the embodiments described herein, a centroid of the ball is located inside the inner diameter of the restriction.

In one or more of the embodiments described herein, the ball is attached to a back surface of the deformable blade.

In one or more of the embodiments described herein, the rigid blade is coupled to the deformable blade.

In one or more of the embodiments described herein, the geometric profile is a skive cut.

In one or more of the embodiments described herein, the deformable blade includes an incline surface at its front edge.

In one or more of the embodiments described herein, the geometric profile is located on the incline surface.

In one or more of the embodiments described herein, a central body is disposed through the bore of the tubular body.

In one or more of the embodiments described herein, the central body is connected to a tubular string.

In one or more of the embodiments described herein, the tubular body is connected to a tubular string.

In one or more of the embodiments described herein, the rigid blade comprises a metal.

In one or more of the embodiments described herein, the deformable blade comprises an elastomer.

In one or more of the embodiments described herein, the deformable blade includes a geometric profile configured to preferentially bend the deformable blade in one direction when the deformable blade encounters the restriction.

In another embodiment, a method of running a stabilizer coupled to a tubular string through a restriction includes coupling the stabilizer to the tubular string, bending the deformable blade in response to contacting the restriction, thereby reducing the outer diameter of the deformable blade; moving the stabilizer past the restriction; and allowing the deformable blade to return to its original diameter. In one embodiment, the stabilizer includes a tubular body having a bore therethrough; a rigid blade disposed on the tubular body; and a deformable blade disposed on the tubular body, wherein the deformable blade includes a geometric profile configured to preferentially bend the deformable blade in one direction when the deformable blade encounters the restriction, and wherein the deformable blade has an outer diameter greater than an outer diameter of the rigid blade.

In another embodiment, a method of removing a wellhead connected to a casing includes coupling a stabilizer to a tubular string having a cutter, bending the deformable blade as the stabilizer passes through the wellhead; and separating the wellhead from the casing using the cutter. In one embodiment, the stabilizer includes a tubular body having a bore therethrough; a rigid blade disposed on the tubular body; and a deformable blade disposed on the tubular body, wherein the deformable blade includes a geometric profile configured to preferentially bend the deformable blade in one direction when the deformable blade encounters the restriction, and wherein the deformable blade has an outer diameter greater than an outer diameter of the rigid blade.

In one or more of the embodiments described herein, the method includes rotating the cutter to separate the wellhead from the casing.

In one or more of the embodiments described herein, the cutter rotates relative to the stabilizer.

In one or more of the embodiments described herein, the stabilizer rotates with the cutter.

In one or more of the embodiments described herein, the stabilizer includes a deflecting member configured to deflect a portion of the deformable blade away from the rigid blade.

In one or more of the embodiments described herein, the deflecting member is disposed between the deformable blade and the rigid blade.

In one or more of the embodiments described herein, the deflecting member is selected from the group of a bump, a spring, a wedge, and a ball.

While the foregoing is directed to embodiments of the present invention, other and further embodiments of the invention may be devised without departing from the basic scope thereof, and the scope thereof is determined by the claims that follow.

The invention claimed is:

1. A stabilizer for passing through a restriction, comprising:

a tubular body having a bore therethrough;

a rigid blade disposed on the tubular body; and a deformable blade disposed on the tubular body, the deformable blade circumferentially aligned with and affixed to the rigid blade, wherein an outer diameter of the deformable blade is larger than an outer diameter of the rigid blade and deformable to a smaller outer diameter, and wherein the deformable blade deflects away from the rigid blade when the deformable blade deforms to the smaller outer diameter.

2. The stabilizer of claim 1, wherein the deformable blade is positioned at an offset relative to a radial axis.

3. The stabilizer of claim 1, wherein the deformable blade is positioned at an angle relative to a radial axis.

4. The stabilizer of claim 3, wherein the deformable blade is positioned at an angle between 25 degrees and 75 degrees relative to a radial axis.

5. The stabilizer of claim 1, wherein the deformable blade includes a recess configured to deflect the deformable blade away from the rigid blade.

6. The stabilizer of claim 5, wherein the recess is positioned at an angle relative to a longitudinal axis of the stabilizer.

7. The stabilizer of claim 5, wherein the recess has a length that is between 10% and 70% of the length of the deformable blade.

8. The stabilizer of claim 1, further comprising a ball attached to the deformable blade.

9. The stabilizer of claim 8, wherein a centroid of the ball is located inside the inner diameter of the restriction.

10. The stabilizer of claim 1, wherein the deformable blade comprises an elastomer.

11. The stabilizer of claim 1, wherein the deformable blade includes a geometric profile configured to preferentially bend the deformable blade in one direction when the deformable blade encounters the restriction.

12. The stabilizer of claim 11, wherein the geometric profile is a skive cut.

13. The stabilizer of claim 11, wherein the deformable blade includes an incline surface at its front edge.

14. The stabilizer of claim 13, wherein the geometric profile is located on the incline surface.

15. The stabilizer of claim 1, wherein the rigid blade is coupled to the deformable blade.

16. The stabilizer of claim 1, further comprising a central body disposed through the bore of the tubular body.

17. The stabilizer of claim 16, wherein the central body is connected to a tubular string.

18. The stabilizer of claim 16, wherein the rigid blade is rotatable relative to the central body.

19. The stabilizer of claim 1, wherein the tubular body is connected to a tubular string.

20. The stabilizer of claim 1, wherein the rigid blade comprises a metal.

21. The stabilizer of claim 1, further comprising a deflecting member configured to deflect a portion of the deformable blade away from the rigid blade.

22. The stabilizer of claim 21, wherein the deflecting member is disposed between the deformable blade and the rigid blade.

23. The stabilizer of claim 1, wherein the rigid blade supports the deformable blade when the deformable blade is urged against the rigid blade.

24. The stabilizer of claim 1, wherein the deformable blade bends in a direction that is tangent to a radius.

25. A method of running a stabilizer coupled to a tubular string through a restriction, comprising:

coupling the stabilizer to the tubular string, wherein the stabilizer includes:

a tubular body having a bore therethrough;

a rigid blade disposed on the tubular body; and a deformable blade disposed on the tubular body, the deformable blade circumferentially aligned with and affixed to the rigid blade, wherein the deformable blade has an outer diameter larger than an outer diameter of the rigid blade;

bending the deformable blade away from the rigid blade to decrease the outer diameter of the deformable blade in response to contacting the restriction, thereby reducing the outer diameter of the deformable blade;

moving the stabilizer past the restriction; and allowing the deformable blade to return to the outer diameter.

26. A method of removing a wellhead connected to a casing, comprising:

coupling a stabilizer to a tubular string having a cutter, wherein the stabilizer includes:

a tubular body having a bore therethrough;

a rigid blade disposed on the tubular body; and a deformable blade disposed on the tubular body, the deformable blade circumferentially aligned with and affixed to the rigid blade, wherein the deformable blade has an outer diameter larger than an outer diameter of the rigid blade;

bending the deformable blade away from the rigid blade to decrease the outer diameter of the deformable blade as the stabilizer passes through the wellhead; and separating the wellhead from the casing using the cutter.

27. The method of claim 26, further comprising rotating the cutter to separate the wellhead from the casing.

28. The method of claim 26, wherein the deformable blade includes a geometric profile configured to preferentially bend the deformable blade in one direction when the deformable blade encounters the restriction.

* * * * *